US007573470B2

(12) United States Patent
Hong

(10) Patent No.: US 7,573,470 B2
(45) Date of Patent: Aug. 11, 2009

(54) METHOD AND APPARATUS FOR DRIVING LIQUID CRYSTAL DISPLAY DEVICE FOR REDUCING THE HEATING VALUE OF A DATA INTEGRATED CIRCUIT

(75) Inventor: Jin Cheol Hong, Gumi-si (KR)

(73) Assignee: LG. Display Co., Ltd., Seoul (KR)

( * ) Notice: Subject to any disclaimer, the term of this patent is extended or adjusted under 35 U.S.C. 154(b) by 715 days.

(21) Appl. No.: 11/205,994

(22) Filed: Aug. 17, 2005

(65) Prior Publication Data

US 2006/0290636 A1 Dec. 28, 2006

(30) Foreign Application Priority Data

Jun. 27, 2005 (KR) ..... 10-2005-0055449

(51) Int. Cl.
*G09G 5/00* (2006.01)

(52) U.S. Cl. ..... 345/204

(58) Field of Classification Search ..... 345/50–55, 345/87–100, 204, 210–213
See application file for complete search history.

(56) References Cited

U.S. PATENT DOCUMENTS 5,892,493 A * 4/1999 Enami et al. ..... 345/94
6,483,494 B1 11/2002 Liaw et al.
2003/0112386 A1* 6/2003 Bu ..... 349/96
2003/0132903 A1 7/2003 Ueda
2003/0151564 A1* 8/2003 Yamashita et al. ..... 345/52
2003/0169241 A1* 9/2003 LeChevalier ..... 345/204
2005/0007324 A1 1/2005 Inada
2005/0078078 A1 4/2005 Morita

FOREIGN PATENT DOCUMENTS

CN 1434432 8/2003
CN 1438622 8/2003
EP 0 678 849 A1 10/1995

(Continued)

OTHER PUBLICATIONS

First Office Action for corresponding Japanese Patent Application Serial No. 2005-340654, dated Mar. 4, 2008.

(Continued)

*Primary Examiner*—Sumati Lefkowitz
*Assistant Examiner*—Rodney Amadiz
(74) *Attorney, Agent, or Firm*—Brinks Hofer Gilson & Lione

(57) ABSTRACT

A method for driving a liquid crystal display is provided. In the method, a first pre-charge voltage and a second pre-charge voltage are generated from an external voltage source separated from a data driving integrated circuit. A data line is pre-charged with the first pre-charge voltage during a first period. The data line is charged to reach a target value of a first data signal during a second period. The data line is pre-charged with the second pre-charge voltage during a third period. The data line is charged to reach a target value of a second data signal during a fourth period. A liquid crystal display device is capable of reducing the heating value of a driver that drives the data line.

2 Claims, 5 Drawing Sheets

FOREIGN PATENT DOCUMENTS

| | | | |
|---|---|---|---|
| EP | 0 755 044 | A1 | 1/1997 |
| EP | 0 821 490 | A1 | 1/1997 |
| GB | 2 362 277 | A | 11/2001 |
| JP | 07-295521 | | 11/1995 |
| JP | 09-033891 | | 2/1997 |
| JP | 09-243998 | | 9/1997 |
| JP | 10-011032 | | 1/1998 |
| JP | 11-030975 | | 2/1999 |
| JP | 2002-026732 | | 1/2002 |

OTHER PUBLICATIONS

Office Action for corresponding German Patent Application Serial No. 10 2005 053 003.6-32, dated Jun. 20, 2007.

Office Action issued in corresponding Japanese Patent Application No. 2005-340654; issued Aug. 19, 2008.

* cited by examiner

100

POWER SOURCE SIGNAL
CONTROL SIGNAL
DATA
40
LOGIC CIRCUIT PART
42
GAMMA VOLTAGE
DAC
44
VDD
48
R1
R2
46
I1
R3
VSS
I2
SW1
50
SW2
Vpos
PRE-CHARGE VOLTAGE SOURCE
SW3
Vneg
Ineg
Ipos
Vdata
49
Rp
Cp

METHOD AND APPARATUS FOR DRIVING LIQUID CRYSTAL DISPLAY DEVICE FOR REDUCING THE HEATING VALUE OF A DATA INTEGRATED CIRCUIT

This application claims the benefit of Korean Patent Application No. P2005-55449 filed in Korea on Jun. 27, 2005, which is hereby incorporated by reference in its entirety.

BACKGROUND

1. Technical Field

The invention relates to a liquid crystal display device, and more particularly, to a method and apparatus for driving a liquid crystal display device capable of reducing a heating value of a driver.

2. Related Art

A liquid crystal display device displays a picture by way of controlling a light transmittance of liquid crystal materials having a dielectric anisotropy using an electric field. To this end, the liquid crystal display device includes a liquid crystal panel having a pixel matrix and a drive circuit for driving the liquid crystal panel.

FIG. 1 illustrates a liquid crystal display device 1 that includes a liquid crystal panel 10 having a pixel matrix, a gate driver 12 for driving a gate lines GL of the liquid crystal panel 10, a data driver 14 for driving a data line DL of the liquid crystal panel 10 and a timing controller 16 for controlling the gate driver 12 and the data driver 14.

The liquid crystal panel 10 includes the pixel matrix having pixels formed in an area defined by each intersection of the gate line GL and the data line DL. Each of the pixels has a liquid crystal cell LC controlling a light transmittance depending on a data signal and a thin film transistor TFT for driving the liquid crystal cell LC. The thin film transistor TFT responds to a scan signal of the gate line GL to maintain a data signal charged to the liquid crystal cell LC. The liquid crystal cell LC has a different arrangement of liquid crystal materials in accordance with the data signal to control a light transmittance, thereby realizing gray levels.

The gate driver 12 supplies sequentially a scan signal to the gate line GL in response to a control signal from the timing controller 16. The data driver 14 coverts a digital data from the timing controller 18 into an analog data signal to supply the analog data signal to the data line DL. The timing controller 16 supplies control signals for controlling the gate driver 12 and the data driver 14, and supplies a digital data to the data driver 14.

The liquid crystal display device 1 is intended to have a high resolution and a large scale. A driving frequency and a load amount of the data driver 14 increase and a heating value of the data driver 14 increases in accordance with a large driving voltage required for improving a picture quality. Temperature of the data driver 14 increases to lower reliance, which imposes safety concern such as fire. Accordingly, there is a need of a liquid crystal display device that may lower the temperature of a data driver.

SUMMARY

By way of introduction only, a method for driving a liquid crystal display is provided. In the method, a first pre-charge voltage and a second pre-charge voltage are generated from an external voltage source separated from a data driving integrated circuit. A data line is pre-charged with the first pre-charge voltage during a first period. The data line is charged to reach a target value of a first data signal during a second period. The data line is pre-charged with the second pre-charge voltage during a third period. The data line is charged to reach a target value of a second data signal during a fourth period.

In other embodiment, a method for driving a liquid crystal display device having a data driving integrated circuit that includes an output buffer is provided. In the method, a first switch is turned off. The first switch is connected between the output buffer and an output terminal of the data driving integrated circuit. The second switch is turned on to pre-charge a supply line of a first pre-charge voltage. The second switch is connected between the supply line of the first pre-charge voltage and the output terminal. A third switch is turned on to pre-charge a supply line of a second pre-charge voltage. The third switch is connected between the supply line of the second pre-charge voltage and the output terminal.

In another embodiment, an apparatus for driving a liquid crystal display device includes an external pre-charge voltage source for generating at least two pre-charge voltages and a data driving integrated circuit. The data driving integrated circuit includes a pre-charge part to select the pre-charge voltage corresponding to the data signal. The pre-charge part is operable to pre-charge the data line with the selected pre-charge voltage.

BRIEF DESCRIPTION OF THE DRAWINGS

These and other objects of the invention will be apparent from the following detailed description of embodiments with reference to the accompanying drawings, in which.

DETAILED DESCRIPTION OF THE PREFERRED EMBODIMENT

A data driver may include a data driving integrated circuit (hereinafter, "data D-IC"). The data D-IC may include a heating generation part and a heating emission part, which affect temperature of the data driver. In one embodiment, a liquid crystal display device may lower the temperature of the data D-IC by reducing a heating value in the heating generation part. Energy is converted to heat in accordance with power consumption of the data D-IC and the heating value of the data D-IC is generated. Accordingly, power consumption needs to be reduced to lower the heating value of the data D-IC.

The heating in the data D-IC is mainly generated in the output part of an output buffer. To reduce a heating value of the data D-IC, a heating in the output part of the output buffer should be minimized. To reduce the heating value of the output buffer part, a pre-charge method of a data line may be used. A charge sharing method may be one example of the pre-charge method of the data line.

Figure 1:
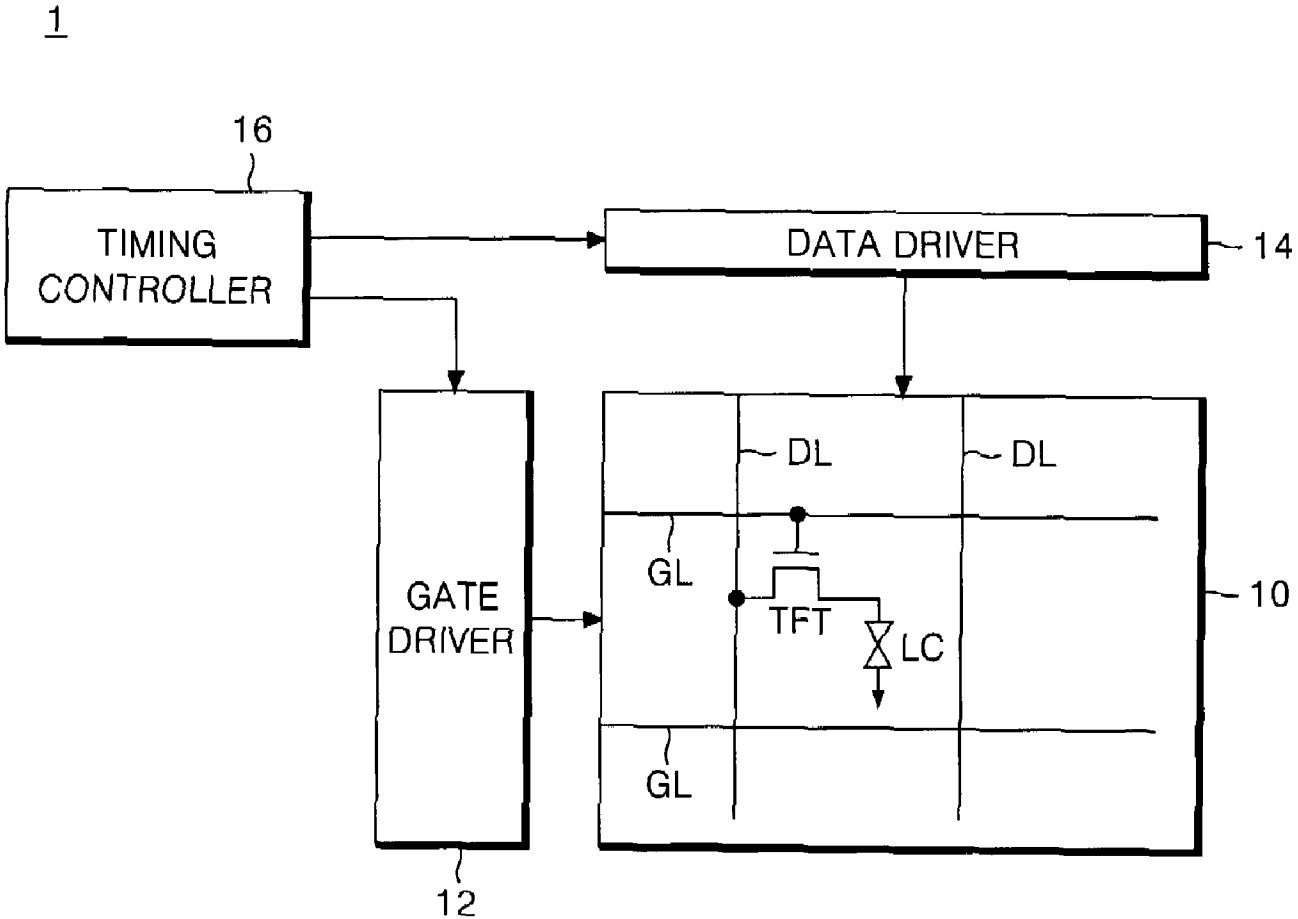
FIG. 1 RELATED ART
FIG. 1 is a block diagram illustrating a related art liquid crystal display device.
Figure 2:
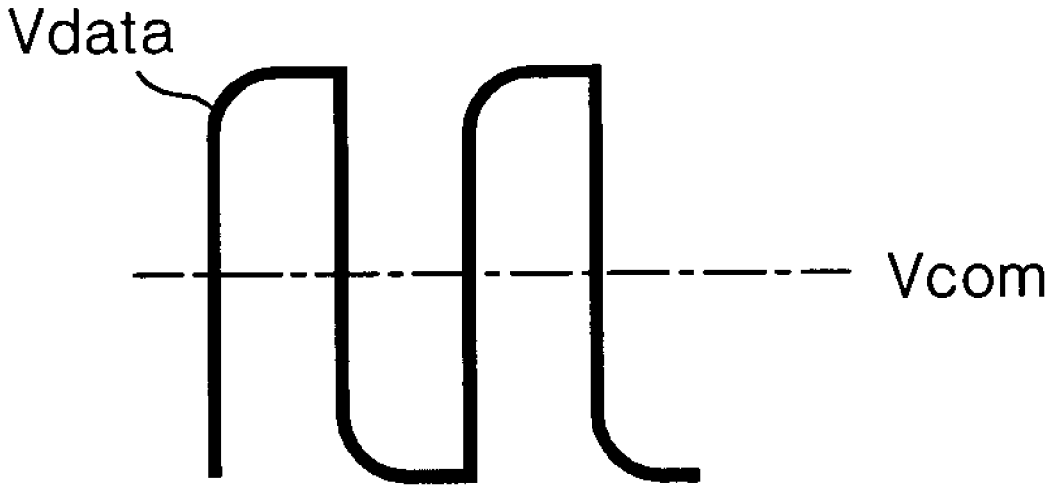
FIG. 2 is a data output waveform diagram of a data driver.

FIG. 2 shows one example of a data output waveform diagram of the data D-IC. A data signal Vdata is output from the data D-IC and is supplied to a data line of a liquid crystal display panel. The data signal Vdata may be a negative or positive voltage with respect to Vcom as shown in FIG. 2. The data signal Vdata may rise to a target value, which ranges between a ground and VDD.

Figure 3:
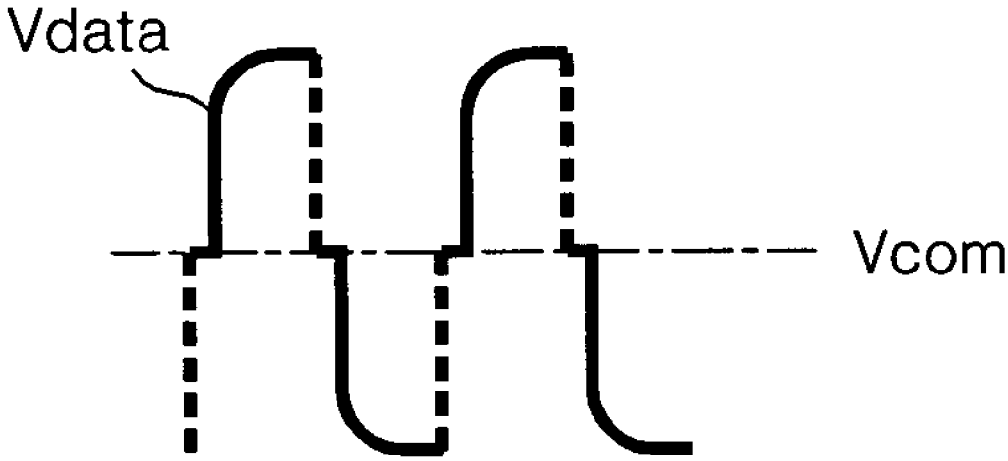
FIG. 3 is a data output waveform diagram in a charge sharing mode.

FIG. 3 illustrates the charge sharing method using an electric charge of the liquid crystal display panel. In FIG. 3, the charge sharing method supplies a voltage of about half of the data signal Vdata shown in FIG. 2. The charge sharing method of the data line is capable of reducing charge and discharge currents of an output buffer part of the data D-IC. The charge sharing method shorts the data lines before charging the data signal Vdata. The entire data lines are pre-charged with a half voltage of the data signal Vdata by using the electric charges charged in the data line in the previous period. Accordingly, a dot line part of the data signal Vdata shown in FIG. 3 is driven by the electric charge charged in the data line, and only solid line part is driven with the output buffer part. As a result, it is possible to reduce the values of charge and discharge currents.

Alternatively, or additionally, panel loads may decrease to reduce the charge and discharge currents. This is because the charge and discharge currents increase as the panel loads increase in a large-sized application.

Figure 4:
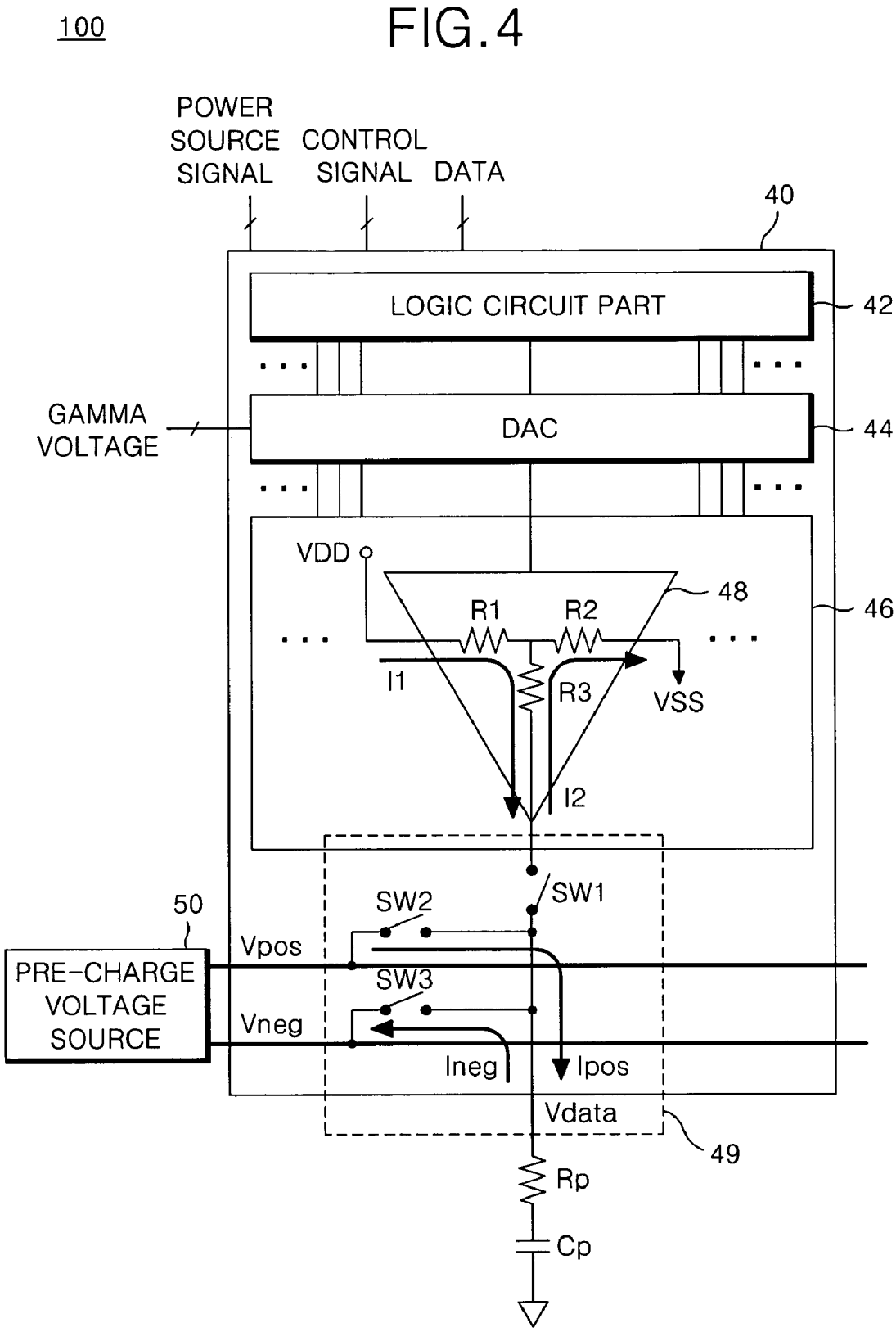
FIG. 4 is a block diagram illustrating a data driver of a liquid crystal display device according to one embodiment.

FIG. 4 is a block diagram illustrating a data driver 100 of a liquid crystal display device according to one embodiment. The data driver 100 includes a data D-IC 40 and a pre-charge voltage source 50 for supplying positive and negative pre-charge voltages, Vpos and Vneg. The pre-charge voltage source 50 is external to the data D-IC 40 and separated from the data D-IC 40.

The pre-charge voltage source 50 generates Vpos and Vneg to supply them to the data D-IC 40. The data D-IC 40 converts a digital data signal into an analog data signal by using a power source signal and a control signal, which are an external input. The data driver D-IC 40 supplies the converted data signal to a data line of a liquid crystal display panel. To this end, the data D-IC 40 includes a logic circuit part 42, a digital to analog converter DAC 44, an output buffer part 46 and a pre-charge part 49, which are sequentially connected between an input terminal and an output terminal thereof.

The logic circuit part 42 sequentially samples a digital data input to latch and supply the digital data to the DAC 44. The DAC 44 converts the digital data from the logic circuit part 42 into the analog data signal by using a gamma voltage and supplies the converted analog data signal to the output buffer part 46. The output buffer part 46 adjusts the level of the data signal Vdata, which is output to the data line, up to the level of an input voltage signal from the DAC 44 to compensate for any voltage loss. The output buffer part 46 includes a plurality of output buffers 48 that are respectively connected to the data lines via the pre-charge part 49.

An output buffer 48 adjusts the level of the data signal Vdata from a voltage pre-charged through the pre-charge part 49 up to the level of an input voltage signal from the DAC 44 by using a charge current I1 from a high potential voltage VDD line and a discharge current I2 to a low potential voltage VSS. In this case, the charge current I1 passes through an internal resistance R1 of a first output transistor and an internal resistance R3 of a switch transistor, and the discharge current I2 passes through the internal resistance R3 of the switch transistor and an internal resistance R2 of a second output transistor.

The pre-charge part 49 pre-charges positive and negative charge voltages Vpos and Vneg from the external pre-charge voltage source 50 to the data line in accordance with a polarity of the data signal Vdata. The data line is charged with a positive voltage during one period and with a negative voltage during a next period, as illustrated in FIGS. 2 and 3. During the one period, the data line is pre-charged with Vpos and during the next period, the data line is pre-charged with Vneg. To this end, the pre-charge part 49 includes a first switch SW1 connected to an output line of the output buffer 48, a second switch SW2 connected between the positive pre-charge voltage Vpos supply line and the output terminal of the data D-IC 40 and a third switch SW3 connected between the negative pre-charge voltage Vneg supply line and the output terminal of the data D-IC 40. The first to the third switches SW1, SW2, and SW3 are respectively connected to each output terminal of the data D-IC 40.

Figure 5:
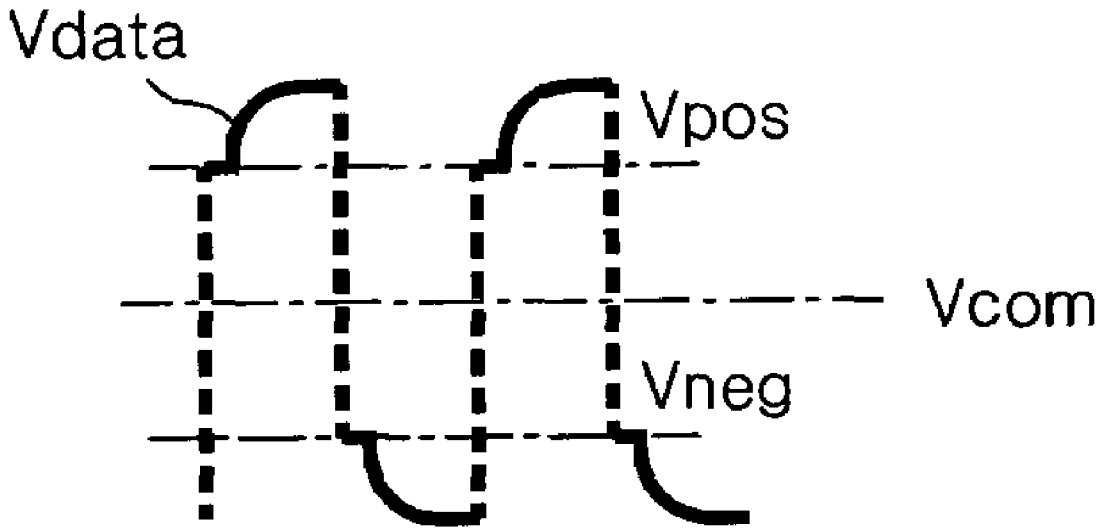
FIG. 5 is a data output waveform diagram of the data driver of FIG. 4.

The first switch SW1 is turned off in a pre-charge period. In the pre-charge period, when the data signal Vdata being charged into the data line has a positive polarity as shown in FIG. 5, the second switch SW2 is turned on to thereby pre-charge the positive pre-charge voltage Vpos to the data line with the charge current Ipos. When the data signal Vdata being charged into the data line has a negative polarity as shown in FIG. 5, the second switch SW3 is turned on to thereby pre-charge the negative pre-charge voltage Vneg to the data line with the discharge current Ineg.

The first switch SW1 is turned on in a data charge period. Accordingly, the data signal Vdata reaches from the pre-charged voltage (Vpos and Vneg) up to a target value with the charge and discharge currents I1 and I2 of the output buffer 48. The target value may range between VDD and a ground.

A method for driving the data driver 40 is performed as follows. The external pre-charge voltage source 50 generates Vpos and Vneg. During a first period, the data line is pre-charged with one of Vpos and Vneg. Depending on the polarity of the data voltage, one of Vpos and Vneg may be selected. During a second period, the data line is charged to reach a target value. During a third period, the data line is pre-charged with Vpos or Vneg. During a fourth period, the data line is charged to reach another target value. The pre-charge voltage during the first period and the data signal voltage during the second period have the same polarity. Likewise, the pre-charge voltage during the third period and the data voltage during the fourth period have the same polarity.

The pre-charge voltage may correspond to a gray level voltage which ranges between a peak black level and a peak white level. In one embodiment, the gray level voltage as the pre-charge voltage may range between ½ VDD and VDD. For example, the pre-charge voltage may be set at ¾ VDD. In other embodiment, the gray level voltage as the pre-charge voltage may range between ½ VDD and a ground. Preferably, the pre-charge voltage may be set at ¼ VDD. The value of the pre-charge voltage described above is by way of example only and is not limited thereto.

The positive and the negative pre-charge voltages Vpos and Vneg may be set to a middle gray level voltage, e.g., about ¾ VDD or ¼ VDD. The middle gray level voltage as the pre-charge voltages may reduce the charge and the discharge current I1 and I2 of the output buffer 48. This is because the discharge current I2 becomes greater when the values of the positive and the negative pre-charge voltages Vpos and Vneg are close to a high gray level voltage, and the charge current I1 also becomes greater when the values of the positive and the negative pre-charge voltages Vpos and Vneg are close to a low gray level voltage.

As a result, in the data signal Vdata shown in FIG. 5, the middle gray level voltage corresponding to a dot line part is driven by the pre-charge part 49 and only solid line part is driven with the output buffer part 46. As a result, the values of the charge and discharge currents I1 and I2 may be reduced than those of the charge sharing mode. Power consumption by the internal resistances R1, R2 and R3 of the output buffer part 26 and the charge and discharge current I1 and I2 may be reduced and the heating value of the output buffer 26 also may be reduced. Moreover, the heating value of the data D-IC 40 decreases. Further, because the data signal Vdata more rapidly reaches the target value due to the pre-charge voltages Vpos and Vneg, a charge characteristic may improve. The pre-charge voltage source 50 is located on a printed circuit board PCB separately from the data D-IC 40, so that the heating value of the data D-IC 40 may not increase due to the pre-charge voltages Vpos and Vneg.

As described above, in the method and apparatus for driving data of the liquid crystal display device, the value of current passing through the internal resistance of the output buffer is reduced by using the pre-charge voltage. The pre-charge voltage may have the value corresponding to the middle gray level. Thus, the heating value of the output buffer and moreover, the heating value of the data D-IC may be reduced. Further, the pre-charge voltage source is separated from the data D-IC and the heating generation caused by the pre-charge voltage source may not affect the temperature of the data D-IC.

As a result, even through the liquid crystal display panel has a high resolution and becomes large in size, the temperature of the data D-IC may be lowered to secure a reliance of the data D-IC.

Although the invention has been explained by the embodiments shown in the drawings described above, it should be understood to the ordinary skilled person in the art that the invention is not limited to the embodiments. Various changes and/or modifications are possible without departing from the spirit of the invention. Accordingly, the scope of the invention shall be determined only by the appended claims and their equivalents.

What is claimed is:

1. A method for driving a liquid crystal display device having a data driving integrated circuit, the method comprising:

providing a liquid crystal device that includes a external pre-charge voltage source, located on a printed circuit board, separated from the driving integrated circuit, wherein the data driving integrated circuit includes an output buffer, an output terminal connected with a data line, and a pre-charging part connected between the output buffer and the output terminal, wherein the output buffer includes first and second internal resistors, connected between VDD and GND, and a third internal resistor connected between a node, between the first and second internal resistors, and the output terminal, during a first period, turning off a first switch connected between the third internal resistor of the output buffer and the output terminal, while turning on a second switch for pre-charging the output terminal with a positive pre-charge voltage and turning off a third switch, wherein the second switch is connected between a first supply line, supplying the positive pre-charge voltage from the external pre-charge voltage source, and the output terminal, and the third switch is connected between a second supply line, supplying a negative pre-charge from the external pre-charge voltage source, and the output terminal;

during a second period after the first period, turning on the first switch for charging the output terminal with a positive data voltage from the output buffer, using a charging current through the first and third internal resistors or a discharging current through the second and third internal resistors, while turning off the second and third switches;

during a third period after the second period, turning off the first switch while turning on the third switch to pre-charge for pre-charging the output terminal with the negative pre-charge voltage and turning off the second switch, and during a fourth period after the third period, turning on the first switch for charging the output terminal with a negative data voltage from the output buffer, using the charging current through the first and third internal resistors or the discharging current through the second and third internal resistors, while turning off the second and third switches, wherein the positive pre-charge voltage is ¾ VDD and the negative pre-charge voltage is be ¼ VDD.

2. An apparatus for driving a liquid crystal display device, comprising:

an external pre-charge voltage source for generating positive and negative pre-charge voltages, the external pre-charge voltage source, located on a printed circuit board, separated from the data driving integrated circuit; and a data driving integrated circuit comprising a pre-charge part connected a output buffer and a data line, wherein the pre-charge part pre-charges the data line with the positive or negative pre-charge voltage corresponding to a polarity of the data signal, wherein the output buffer includes first and second internal resistors, connected between VDD and GND, and a third internal resistor, connected between a node, between the first and second internal resistors, and the output terminal, wherein the pre-charge part includes first to third switches, further wherein the first switch is connected the third internal resistor of the output buffer, the second switch is connected between a first supply line, supplying the positive pre-charge voltage from the external pre-charge voltage source, and the output terminal, and the third switch is connected between a second supply line, supplying a negative pre-charge from the external pre-charge voltage source, and the output terminal, wherein, during a first period, the first switch is turned-off for the output buffer electrically separating from output terminal, while the second switch is turned-on for pre-charging the output terminal with the positive pre-charge voltage and the third switch is turned-off, wherein, during a second period after the first period, the first switch is turned-on for charging the output terminal with the positive data voltage from the output buffer, using a charging current through the first and third internal resistors or a discharging current through the second and third internal resistors, while the second and third switches are turned-off;

wherein, during a third period after the second period, the first switch is turned-off for the output buffer electrically separating from the out terminal while the third switch is turned-on for pre-charging the output terminal with the negative pre-charge voltage and the second switch is turned-off, and wherein, during a fourth period after the third period, the first switch is turned-on for charging the output terminal with a negative data voltage from the output buffer, using the charging current through the first and third internal resistors or the discharging current through the second and third internal resistors, while the second and third switches are turned-off, wherein the positive pre-charge voltage is ¾ VDD and the negative pre-charge voltage is be ¼ VDD.

* * * * *

UNITED STATES PATENT AND TRADEMARK OFFICE

CERTIFICATE OF CORRECTION

PATENT NO. : 7,573,470 B2
APPLICATION NO. : 11/205994
DATED : August 11, 2009
INVENTOR(S) : Jin Cheol Hong It is certified that error appears in the above-identified patent and that said Letters Patent is hereby corrected as shown below:

In the Claims

In column 6, claim 2, line 32, after "switch is connected" insert --to--.

In column 6, claim 2, line 54, after "separating from the" replace "out" with --output--.

Signed and Sealed this

Sixteenth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,573,470 B2
APPLICATION NO. : 11/205994
DATED : August 11, 2009
INVENTOR(S) : Jin Cheol Hong It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1027 days.

Signed and Sealed this

Seventh Day of September, 2010

David J. Kappos

David J. Kappos
*Director of the United States Patent and Trademark Office*